United States Patent [19]

Mackness et al.

[11] Patent Number: 4,887,367

[45] Date of Patent: Dec. 19, 1989

[54] SHOCK ABSORBING SHOE SOLE AND SHOE INCORPORATING THE SAME

[75] Inventors: Terry Mackness; Frank V. Wezel, both of Southend-on-Sea, England

[73] Assignee: Hi-Tec Sports PLC, Essex, England

[21] Appl. No.: 217,188

[22] Filed: Jul. 11, 1988

[30] Foreign Application Priority Data

Jul. 9, 1987 [GB] United Kingdom ..... 8716200
May 31, 1988 [GB] United Kingdom ..... 8812867

[51] Int. Cl.[4] ..... A43B 13/18

[52] U.S. Cl. ..... 36/28; 36/29; 36/35 R; 36/35 B; 36/129

[58] Field of Search ..... 36/28, 29, 35 R, 35 B, 36/114, 129

[56] References Cited

U.S. PATENT DOCUMENTS

| | | | |
|---|---|---|---|
| 3,044,190 | 6/1962 | Urbany | 36/29 |
| 4,364,188 | 12/1982 | Turner | 36/129 |
| 4,535,553 | 8/1985 | Derderian | 36/29 |
| 4,616,431 | 10/1986 | Dassler | 36/28 |
| 4,680,876 | 6/1987 | Peng | 36/35 R |

FOREIGN PATENT DOCUMENTS

| | | | |
|---|---|---|---|
| 2356936 | 5/1974 | Fed. Rep. of Germany | 36/28 |
| 2709478 | 9/1978 | Fed. Rep. of Germany | 36/29 |
| 3216299 | 10/1983 | Fed. Rep. of Germany | 36/29 |
| 3245964 | 6/1984 | Fed. Rep. of Germany | 36/35 R |
| 82/0571 | 3/1982 | PCT Int'l Appl. | 36/29 |
| 0223748 | 10/1924 | United Kingdom | 36/28 |
| 1603646 | 11/1981 | United Kingdom | 36/29 |

*Primary Examiner*—Werner H. Schroeder
*Assistant Examiner*—Diana L. Biefeld
*Attorney, Agent, or Firm*—Pollock, Vande Sande & Priddy

[57] ABSTRACT

An improved structure of the sole of shoes suitable for use in sports or any casual wear is characterized in that the mid-sole is provided with resilient spherical bodies within recesses in the front portion and/or the heel portion of the sole, and that the hardness of the resilient bodies can be adjusted to enhance the elasticity of the soles of the shoes by virtue of the fact that the spherical bodies can be inflated and deflated or can be bodily replaced, thereby enabling the requisite shock absorbing effect to relieve impact stress during running and fatigue during long walking to be obtained.

17 Claims, 4 Drawing Sheets

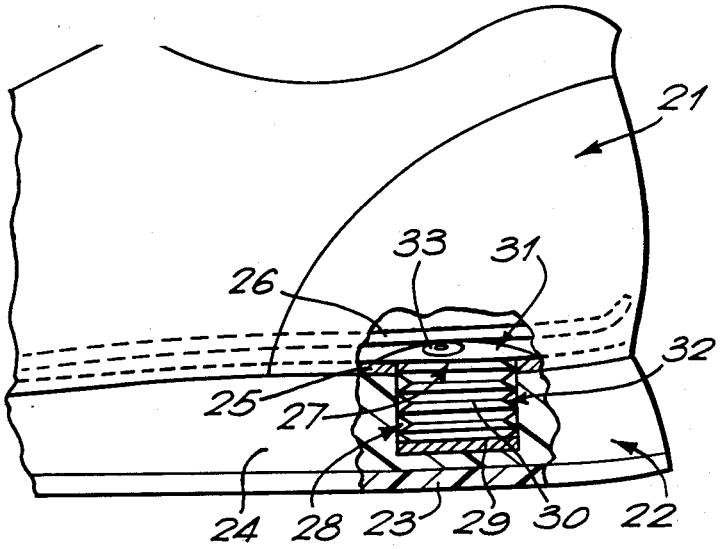
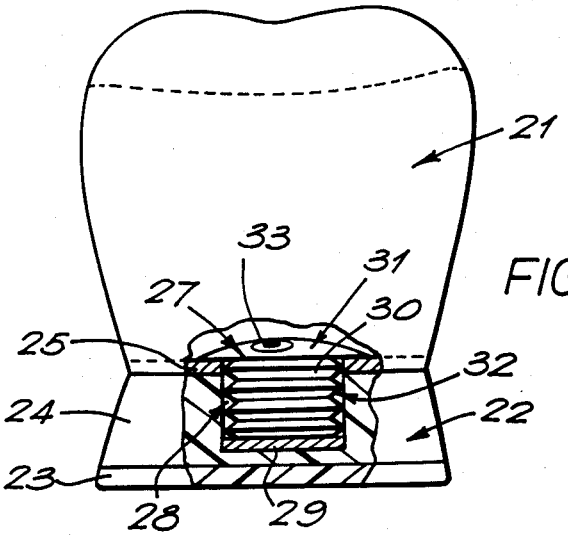
FIG.6.

SHOCK ABSORBING SHOE SOLE AND SHOE INCORPORATING THE SAME

FIELD OF THE INVENTION

The present invention relates generally to sports shoes or casual shoes and more specifically concerns improved shock absorbing shoe soles and shoes incorporating the same.

BACKGROUND OF THE INVENTION

Generally speaking, most people put their bodies under varying degrees of impact during exercise, and it has been established that the forces exerted on the heel and the ball or front sole of the feet during running are three to four times greater than those exerted during normal walking. Thus, during running or jogging, the reaction forces exerted on the body from the ground may be three to four times higher than individual body weight. Not only is this the cause of many sports injuries, but also it makes the participants tired or exhausted. Sports shoes for running or jogging or playing games and casual shoes for walking are commercially available in a variety of designs, but, generally speaking, the soles of such shoes and consequently the shoes in their entirety do not match the individual requirements of the wearer as regards providing the desired degree of resilience and elasticity.

It is known to provide means in a sports shoe for enabling the characteristics of the shoe to be adapted to the requirements of the user. For example, U.S. Pat. No. 4, 430, 810 discloses an arrangement wherein a number of bores extend through the relatively soft material of the heel portion of a running shoe from one side thereof to the other, the bores being spaced apart from each other in the longitudinal heel-to-toe direction of the shoe, and rod-shaped stiffening members of selectable greater hardness than the soft heel material can be inserted into the bores so as selectively to increase the overall hardness of the sole and adapt the shockabsorbing capabilities of the shoe to the individual requirements of the runner and to the nature of the surface upon which he intends to run. The proposal to stiffen the heel of a shoe by insertion of appropriate stiffening elements into bores in the heel is known also from French Patent No. 958,766, and in U.S. Pat. No. 3,785,646 discloses a shoe having a rubber sole with transverse bores into which rod-like metal weights may be inserted. Another arrangement, known from applicants British Patent No. 2,156,654, not only enables heel hardness characteristics to be selectively varied to suit the requirements of the wearer, but also allows different relative hardnesses to be achieved on different sides of the heel for controlling rear-foot movement and minimizing the risk of damage through excessive pronation or supination. Another known arrangement of only marginal interest to the present invention is disclosed in European Patent Application Ser. No. 0161653.

It is further known to incorporate air pockets into the heel portion and/or the sole portion of a shoe so as to provide shock absorption and/or resiliency properties. Described in British Patents Nos. 2,150,0010 and 2,183,446 are shoes which incorporate an inflatable bladder within a cavity in the heel portion of the shoe, the degree of inflation of the bladder in each case being selectively variable. The shoe of British Patent No. 2,150,010 also incorporates a plurality of sealed air pockets generally in the metatarsal region of the ball of the foot. Disclosed in European Patent Application Serial No. 0160880 is a molded shoe sole wherein air can transfer between cavities defined by bulges molded into the sole and heel portions for providing shock absorption and movement facilitation characteristics, though without any possibility of adjusting the air pressure within the cavities. An arrangement similar to that disclosed in European Patent Application Serial No. 0160880 is described in British Patent Application No. 2,073,006, and in the latter case means are provided to enable the desired fluid pressure in the interconnected cavities to be determined. A shoe provided with a selectively inflatable insole is described in British Patent No. 358,205. The shoe described in International Patent Application No. WO 82/00571 has a gas pressure chamber in its sole and includes a pump arrangement which keeps the gas pressure constant. Other shoes incorporating pneumatic structures in their heel and/or sole portions are described in British Patent Specifications Nos. 390,368, 490,647, 2,023,405 and 2,034,169 and in U.S. Pats. Nos. 4,183,156, 4,219,945 and 4,271,606.

None of the aforementioned documents discloses a sports shoe, or a sole for such a shoe, which affords to the user the degree of selectable resilience that is afforded by a pneumatic sole structure having means for pressure adjustment, coupled with selectability as regards the distributed hardness characteristics within the sole and/or heel region.

SUMMARY OF THE INVENTION

The principal object of the present invention thus is to overcome or at least substantially reduce the abovementioned disadvantages of conventional shoes.

The present invention in one of its aspects resides in the concept of relieving impact forces on the heels and/or front soles of the feet during exercise, and thereby reducing injuries and fatigue, by incorporating resiliently deformable bodies of selectable or adjustable hardness characteristics in a removable and interchangeable manner within accommodating recesses provided in the thickness of the shoe sole between the inner sole of the shoe contacted by the wearer and the ground contacting sole surface.

Thus, in one exemplary shoe construction according to the invention, spherical pneumatic bodies are provided in accommodating recesses in the shoe sole, with the curved surfaces of the spherical bodies between and in contact with the insole and undersole of the shoe and the bodies, or at least some of them, being selectively inflatable and deflatable to accommodate individual body weights and exercise habits. For wearers who prefer hard soles, the pneumatic bodies may be pumped up relatively hard, whereas, for those who prefer soft soles, they can be softened by releasing some air therefrom.

Furthermore or alternatively, the elasticity of the soles may be adjustably determinable, at least in part, in accordance with the invention, by use of solid or foamed elastomer spherical bodies of selectably different durometer hardnesses, selected for example from three different hardnesses, of 35°, 45°, or 55°, to accommodate individual exercise habits. Such different hardness bodies might for example be made from different densities of EVA (ethylene vinyl acetate), or, if made from foamed elastomer, might be of a closed-cell foamed plastic material so as to take advantage of the resilience imparted by the entrapped gases.

In the structure of conventional sports and casual shoes, each shoe is constructed with an upper and a sole extending the full length of the shoe from the heel to the toes, the sole generally comprising a treaded outer wear-resistant sole, a mid-sole portion formed for example of foamed plastics material, an inserted heel sometimes called a heel wedge and an insole pad which usually is removable. In the structure of an exemplary sole of the present invention, the heel and also the metatarsal region of the front sole is provided with one or more punched holes or otherwise formed recesses which penetrate directly from the insole pad to but not through the outer sole through the mid-sole and the heel insert. These recesses underlying the removable insole are accessible to the wearer and may be used by the wearer to removably accommodate small balls or other bodies of different size or diameter and different durometer hardnesses to provide adequate elasticity and support during sporting and recreational activities. As previously mentioned herein, the removable balls may be selectively inflatable for determining their hardness characteristics, or may alternatively be formed of elastomeric material of selectable density and durometer hardness or of a foamed plastic material, preferably of closed-cell configuration.

The bodies received in the heel and/or front-sole recesses do not have to be of spherical configuration in accordance with the invention, other shapes being possible. Thus, according to a further exemplary sole of the present invention, generally cylindrical air-filled bodies are axially received within the recesses, the bodies preferably having concertinafolded cylindrical walls, whereby the resilience of the bodies is concentrated predominantly in their axial direction so as to be of greatest assistance to the wearer of the shoe.

By virtue of the sole structure according to the present invention, the impact forces arising from contact with the ground can be distributed to suit the special requirements of the user. Particularly in the case where the bodies incorporated into the shoe sole are inflatable, but also in other cases, the shock absorber bodies can be selectively adjusted to provide or to maintain a given elastic response. Furthermore, the weight of the shoe itself can be reduced, because the punched hole portions can accommodate insert bodies in the form of air sacs which are certainly lighter than the EVA or PU (polyurethane) material of the heel insert; during exercise, the lighter the shoes, the greater generally are the benefits to the exerciser. Additionally, the geometric shape of the insert bodies enables optimum elasticity characteristics to be achieved, and by providing the wearer with direct access to the insert bodies, the option is obtained to further increase the flexibility of use by varying the degree of inflation of the bodies with air or other gases, or even by the injection of fluids such as oils, emulsions, water, hydrogen, helium etc., into the bodies.

BREIF DESCRIPTION OF THE DRAWINGS

Other features of the present invention are set forth with particularity in the appended claims and will become apparent from the following detailed description of exemplary embodiments which are illustrated in the accompanying drawings.

FIG. 5 shows schematically a side-elevation view of the construction of the heel portion of a further sports shoe in accordance with the present invention; and FIG. 6 is a schematic sectional end-elevation view of the heel portion of the sports shoe of FIG. 5.

DESCRIPTION OF PREFERRED EMBODIMENTS

Figure 1:
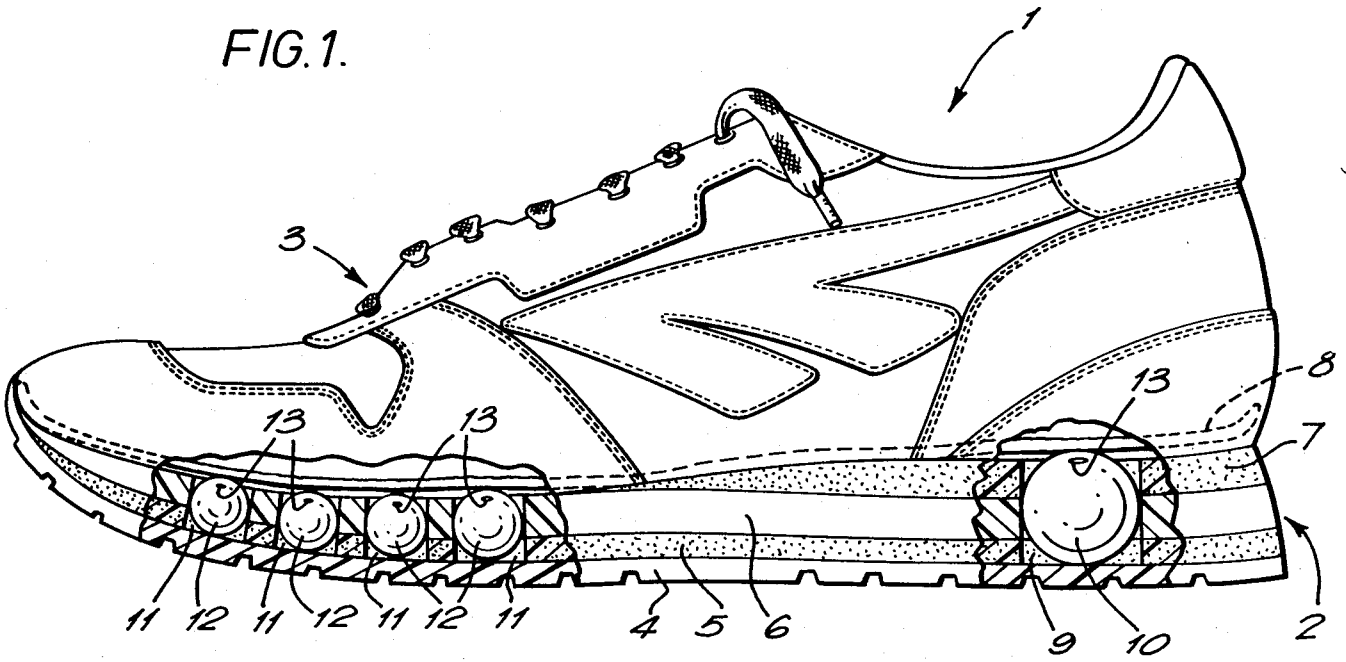
FIG. 1 is a schematic side view, partly in cut-away cross-section, showing an exemplary sports shoe provided in its sole portion with spherical resilient bodies according to the teachings of the present invention.

Referring to FIG. 1, a running shoe generally designated 1 is shown. The shoe 1 includes a sole 2 and an upper 3 secured to the sole, the upper (as is conventional) including a reinforced counter or heel cup surrounding the heel portion of the shoe.

The sole has a synthetic rubber base 4 in which a tread pattern of gripping elements or cleats is formed. The base 4 is attached, for example by means of adhesive or by welding, to a first resilient midsole layer 5 which is in turn attached to a further resilient midsole layer 6, for example by means of adhesive or by welding. The midsole layers 5, 6 may be formed of foamed plastic materials and could, if desired, be formed in one piece rather than as two separate pieces. A further resilient heel wedge layer 7 formed from foamed plastic material is provided at the heel end of the shoe 1. The layer 7 raises the heel portion of the shoe and may be attached to the layer 6 by means of adhesive or by welding, for example, and may be formed all in one piece or alternatively may be formed in two or more longitudinally extending pieces which advantageously can have increasing durometer hardnesses towards the peripheral edges of the heel to ensure lateral stability throughout the life of the shoe.

The complete sole 2 may be secured to the upper 3 by means of adhesive, for example, and a removable insole or foot-bed 8 is provided within the shoe.

Figure 2:
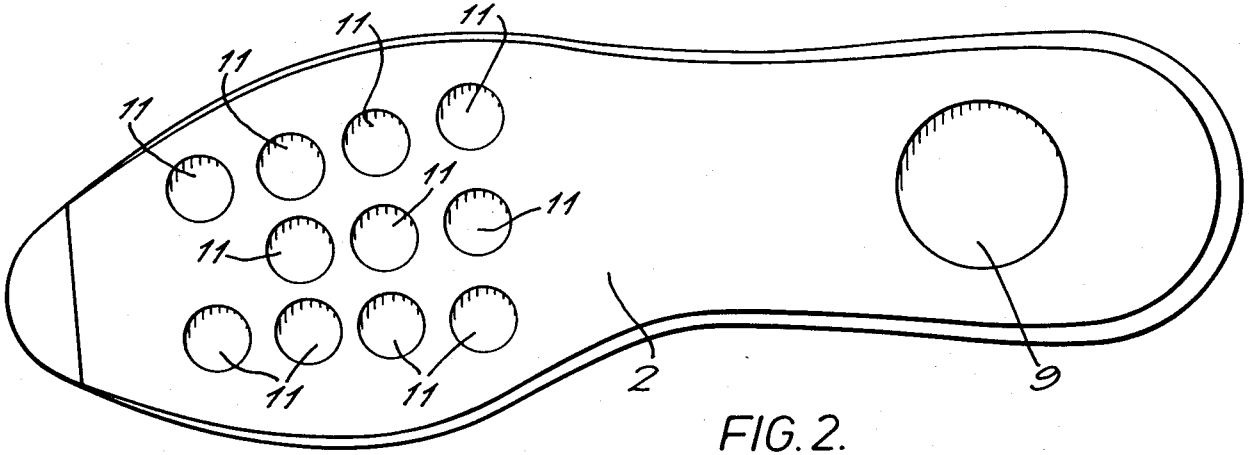
FIG. 2 is a top plan view of the sole of the sports shoe of FIG. 1, showing the disposition of the spherical resilient bodies in the shoe sole.

Further shown in FIG. 1 is the provision of resilient spherical bodies in the sole of the shoe at the heel and at the ball of the foot. At the heel portion of the shoe there is formed a recess 9 defined by holes punched in the mid-sole layers 5,6 and in the inserted heel wedge 7, and a resilient spherical body 10 is inserted into the recess 9 as shown. The spherical body 10 sits within the recess 9 with its lower surface in tangential contact with the upper surface of the outer sole 4 and its upper surface projecting slightly above the upper surface of the heel wedge 7 for tangentially contacting the underside of the removable insole 8. Further recesses 11 are provided, in a similar manner, at the front portion of the sole in the region of the ball of the wearer's foot, these further recesses as shown being of smaller diameter and greater number than the recess 9 in the heel and being arranged in two or three or more rows each of a plurality of recesses as shown in FIG. 2, and resilient spherical bodies 12 of smaller diameter than the one provided in the heel are accommodated in respective ones of these recesses. As described hereinafter, the resilient spherical bodies 10,12 have the function of determining the elasticity characteristics of the shoe.

FIG. 2 shows a top plan view of the shoe sole 2 and illustrates the arrangement of the recesses 11 in the region of the ball of the foot, it being understood that the illustrated arrangement is exemplary only.

Figure 3:
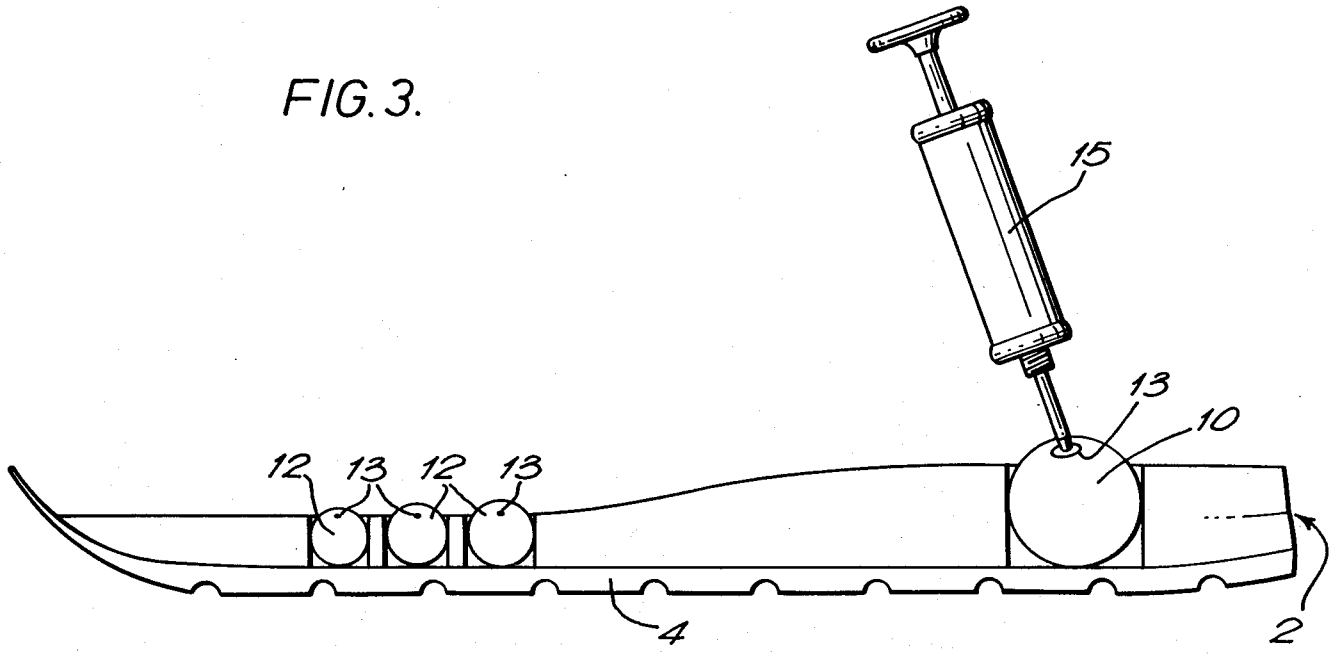
FIG. 3 is a schematic side view of an alternative shoe sole according to the present invention, showing the spherical resilient bodies being inflated by means of an air pump.

The resilient spherical bodies 10,12, or at least some of them, are preferably gas-filled pneumatic bodies, and preferably are provided with an inflation valve port 13 whereby, as shown in FIG. 3, air may be pumped into or released from the respective spherical body 10,12 by means of an air pump 15, thus to increase or decrease the hardness characteristics of the spherical body for matching the shoe to the body weight and individual requirements of the wearer. This facility is advantageous particularly in the course of a long run, such as a marathon, or a long game, since it enables the shoe characteristics to be adjusted during the run or during the game to take account of different conditions and changing levels of fatigue. On a long run, running shoes can become up to 15° C. hotter than at the start of the run, on account of friction effects, which can cause the inflatable bodies 10,12 to become undesirably firm and insufficiently cushioning. This problem can be overcome, in accordance with the invention, by adjusting the pressure of the inflatable bodies.

In use of a sports shoe constructed in accordance with the present invention, the presence of the resilient bodies provides excellent cushioning and protection against shock, and also provides a resilience to the shoe characteristics which is invigorating and beneficial, the resilience of the spherical bodies as they resile from their compressed states as the foot is lifted providing a positive spring to the step of the wearer.

Figure 4:
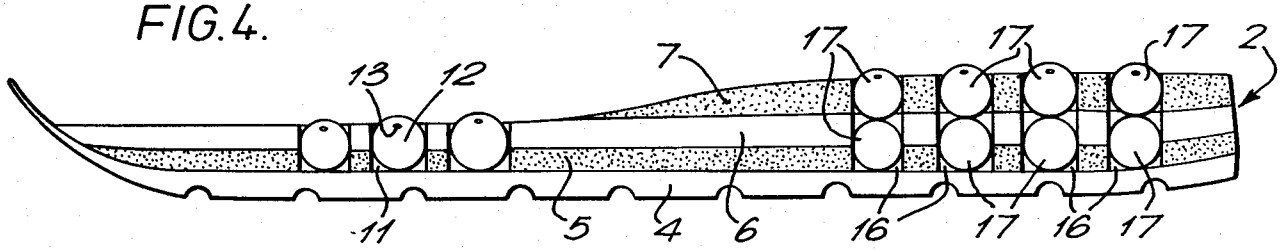
FIG. 4 is a schematic side view of an alternative sole construction according to the invention wherein a plurality of spherical bodies may be inserted in accordance with the wearers requirements into each of a plurality of recesses in the heel portion of the shoe sole.

FIG. 4 shoes schematically a form of shoe sole in accordance with the invention which has a plurality of recesses 16 provided in the heel region of the sole, each recess being of lesser size than the corresponding heel recess provided in the shoe of FIG. 1, and has a plurality of pneumatic bodies 17 provided in each recess, some at least of such bodies being selectively inflatable and deflatable. One effect of this arrangement is to provide a more uniform distribution throughout the heel area of the shoe sole of the advantageous effects provided by the arrangement of FIG. 1.

Referring now to FIGS. 5 and 6 of the drawings, the shoe shown schematically therein comprises an upper 21 and a sole 22, the sole comprising a rubber outsole layer 23, a midsole 24 formed of one or more layers of compression molded EVA, for example, an insole 25 formed of Texon board, for example, and a removable footbed 26 which desirably is reinforced so as to contribute to the lateral stability of the shoe, for example by being transversely ridged. As shown, an opening 27 is provided in the insole 25 in registry with a recess 28 formed in the midsole 24, a reinforcing piece of Texon board 29 is provided in the bottom of the recess 28, and a gas-filled member 30 is received partially within the recess 28.

The gas-filled member 30 as shown has a domed upper or head portion 31 of greater transverse dimension than the opening 27 provided in the insole 25 so that such head portion 31 does not fit into the recess 28 formed in the midsole 24, but rather rests upon the upper surface of the Texon insole 25 around the periphery of the opening 27 and defines an upwardly domed gas cushion seated on the insole. A body portion 32 of the gas-filled member 30 is of generally cylindrical shape, with concertina side walls as shown and a flat base, and fits into the recess 28 formed in the midsole 24.

The gas-filled member 30 is preferably arranged to be removable from its accommodating recess in the shoe sole, and different members having different gas pressures can be made available whereby the shoe can be configured to suit the requirements of the user. Additionally, or alternatively, the gas-filled member 30 can as shown be provided with a valve 33 enabling it to be selectively inflated or deflated.

The concertina-pleated side walls of the gas-filled member 30 provided the advantage that the pneumatic resilience of the member is substantially unidirectional and in the axial direction of its accommodating recess, which is advantageous as regards the stability of the shoe.

The lateral edges of the midsole 24, at least in the region of the heel of the shoe, may be of greater durometer hardness than the central midsole region to ensure that the lateral stability of the shoe is maintained during the life of the shoe. This is indicated schematically in FIG. 6 by the shaded lateral areas of the midsole 24 and might, for example, be achieved by forming the midsole of a number of different portions formed of different density materials and adhered together.

The gas-filled member 30 can be made in the form of a single hollow gas-filled sac formed of a suitable synthetic plastic material, or could be a composite body formed as a plurality of gas-filled sacs adhered together. Alternatively, the gas-filled member 30 could be formed in whole or in part as a closed-cell foamed plastic structure. Additionally, pneumatic resilience could be provided in the ball of the foot region of the shoe by incorporation therein of resilient bodies similar to the member 30 or of any other suitable shape and form. Furthermore, while FIGS. 5 and 6 show the provision of only one resilient member 30 in the heel of the shoe, it will be appreciated that more than one such member could be provided.

While the invention has been described herein in relation to specific embodiments, it is to be well understood by those skilled in the art that the invention can be embodied in other forms. For example, the resilient bodies provided in the shoe sole can be of virtually any shape that is capable of providing cushioning; they could comprise, for example, circular disc shaped bodies, oval or egg shaped hemispherical bodies, cylindrical bodies, rectangular or etc. Furthermore, the resilient bodies need not be inflatable, but could, for example, comprise solid elastomeric material.

We claim:

1. A sport shoe or casual shoe comprised of an upper and a sole, the sole comprising an outer sole, a mid-sole and an insole, and wherein the mid-sole is configured with at least one hole so as to define at least one recess within the sole, and at least one resilient body of selectable hardness characteristics is received within said at least one recess, said at least one resilient body being provided with a port or valve whereby a fluid may be introduced into or extracted from the body for changing the characteristics thereof to match the requirements of the wearer.

2. A sports shoe or casual shoe according to claim 1 wherein said port or valve is accessible via the insole of the shoe.

3. A sports shoe or casual shoe according to claim 1, in which said at least one resilient body is adapted to be replaceable by the wearer via the insole.

4. A sports shoe or casual shoe according claim 1 in which a plurality of resilient bodies selected in dependence upon the wearers requirements are adapted to be inserted into said at least one recess.

5. A sports shoe or casual shoe according to claim 1 wherein said at least one resilient body is generally spherical.

6. A sports shoe or casual shoe according to claim 1 wherein said at least one resilient body is generally cylindrical with its axis generally perpendicular to the plane of the sole.

7. A sports shoe or casual shoe according to claim 6 wherein the cylindrical side wall of said at least one resilient body is concertina-pleated.

8. A sports shoe or casual shoe according to claim 6, wherein said at least one resilient body has an enlarged domed head portion underlying the insole.

9. A sports shoe or casual shoe according to claim 1 wherein said at least one recess is provided in a heel portion of the shoe sole.

10. A sports shoe or casual shoe according to claim 1 wherein said at least one recess is provided in a metatarsal portion of the shoe sole.

11. A sports shoe or casual shoe according to claim 11, in which at least one said recess is provided in the heel portion of the shoe and a plurality of such recesses are distributed throughout the metatarsal portion of the shoe.

12. A sports shoe or casual shoe according to claim 10, in which at least one said recess is provided in the heel portion of the shoe and a plurality of such recesses are distributed throughout the metatarsal portion of the shoe.

13. A sports shoe or casual shoe comprising an upper, a sole, and a removable insole, said sole comprising a wear-resistant outsole layer, at least one midsole layer, and a heel wedge, at lest one recess being defined in said heel wedge and midsole layer between the underlying outsole and the overlying insole, and a pneumatically resilient body of selectable hardness characteristics being received within the at least one recess and being accessible for changing the hardness characteristics thereof by removal of the insole, said pneumatic resilient member comprising a generally cylindrical member axially received in said recess and having a first end supported by the axially innnermost end of said recess and a second enlarged end defining a domes upper end surface underlying said removable insole and peripherally supported by said midsole layer, the cylindrical surface of said pneumatic resilient member being concertina-pleated whereby the pneumatic resilience of said member is predominantly axially directed.

14. A sports shoe or casual shoe comprising an upper, a sole, and a removable insole, said sole comprising a wear-resistant outsole layer, at least one midsole layer, and a heel wedge, a first recess being formed in said heel wedge and midsole layer at a first location corresponding to the heel of a wearer's foot, a plurality of second recesses being formed in said midsole layer at a plurality of second locations corresponding to the metatarsal region of a wearer's foot, said recesses being bounded on the underside by the outsole layer and above by the removable insole, a first resilient body of selectable hardness characteristics removably received in said first recess, the first resilient body comprising a gas-filled body and valve means for selectively inflating and deflating said body, and a plurality of second resilient bodies of selectable hardness characteristics removably received in said plurality of second recesses.

15. A sports shoe or casual shoe according to claim 14, wherein at least some of said plurality of second resilient bodies comprise gas-filled bodies.

16. A sports shoe or casual shoe according to claim 14, wherein at least some of said plurality of second resilient bodies comprise elastomer bodies of selected hardness characteristics.

17. A sports shoe or casual shoe comprising an upper, a sole, and a removable footbed, said sole comprising a wear-resistant outsole, a midsole, and an insole, said removable footbed overlying said insole, and wherein an opening in said insole in the region thereof which corresponds to the heel of said shoe communicates with an opening in said midsole so as to define a recess extending between said outsole and said removable footbed, and a pneumatic resilient member is accommodated in said recess, said pneumatic resilient member comprising a generally cylindrical member axially received in said recess and having a first end supported by the axially innermost end of said recess and a second enlarged end defining a domed upper end surface underlying said removable footbed and peripherally supported by said insole, the cylindrical surface of said pneumatic resilient member being concertina-pleated whereby the pneumatic resilience of said member is predominantly axially directed.

* * * * *

UNITED STATES PATENT AND TRADEMARK OFFICE

CERTIFICATE OF CORRECTION

PATENT NO. : 4,887,367

DATED : DECEMBER 19, 1989

INVENTOR(S) : Terry MACKNESS; Frank VAN WEZEL

It is certified that error appears in the above-identified patent and that said Letters Patent is hereby corrected as shown below:

Column 7, line 25:
Claim 11 should be dependent on claim 9.

Column 7, line 37:
Claim 13, line 4, the word "least" is misspelled.
Column 7, line 47:
Claim 13, line 14, the word "domed" is misspelled..

Signed and Sealed this

Fifteenth Day of October, 1991

*Attest:*

*Attesting Officer*

HARRY F. MANBECK, JR.

*Commissioner of Patents and Trademarks*